US007997168B2

(12) United States Patent
Kinskey

(10) Patent No.: US 7,997,168 B2
(45) Date of Patent: Aug. 16, 2011

(54) ADJUSTABLE RATCHET WRENCH

(76) Inventor: Terry Kinskey, Alpharetta, GA (US)

( * ) Notice: Subject to any disclaimer, the term of this patent is extended or adjusted under 35 U.S.C. 154(b) by 498 days.

(21) Appl. No.: 11/918,840

(22) PCT Filed: Mar. 2, 2006

(86) PCT No.: PCT/US2006/007512

§ 371 (c)(1),
(2), (4) Date: Dec. 24, 2008

(87) PCT Pub. No.: WO2006/096482

PCT Pub. Date: Sep. 14, 2006

(65) Prior Publication Data

US 2010/0064858 A1 Mar. 18, 2010

Related U.S. Application Data

(63) Continuation-in-part of application No. 11/070,203, filed on Mar. 3, 2005.

(51) Int. Cl.
*B25B 13/46* (2006.01)

(52) U.S. Cl. ..... 81/63; 81/426.5; 81/163

(58) Field of Classification Search ..... 81/60–63.2, 81/63, 177.4, 424.5, 426.5, 163
See application file for complete search history.

(56) References Cited

U.S. PATENT DOCUMENTS

| | | | |
|---|---|---|---|
| 275,079 | A | 4/1883 | Reichling |
| 600,158 | A | 3/1898 | Miller |
| 915,443 | A | 3/1909 | Jones |
| 928,764 | A | 7/1909 | Jenrich |
| 2,318,363 | A | 5/1943 | Boddy |
| 3,635,654 | A | 1/1972 | McFarland |
| D238,140 | S | 12/1975 | Guimarin |
| 4,016,782 | A | 4/1977 | Guimarin |
| 4,112,792 | A | 9/1978 | Guimarin |
| 4,898,052 | A | 2/1990 | Kang |
| 4,898,247 | A | 2/1990 | Springfield |
| 5,007,312 | A | 4/1991 | Bailey |
| 5,015,047 | A | 5/1991 | Nock |
| 5,076,121 | A | 12/1991 | Fosella |
| 5,207,129 | A | 5/1993 | Fossella |
| 5,305,670 | A | 4/1994 | Fossella et al. |
| 5,603,247 | A | 2/1997 | Wei |
| 5,893,306 | A | 4/1999 | Owoc |
| 5,960,683 | A | 10/1999 | Malkin et al. |
| 6,003,413 | A | 12/1999 | Macor |
| 6,164,167 | A | 12/2000 | Chen |
| 6,431,034 | B1 | 8/2002 | Chen |

(Continued)

FOREIGN PATENT DOCUMENTS

| | | | |
|---|---|---|---|
| DE | 299 04 760 | U | 6/1999 |

(Continued)

*Primary Examiner* — D. S Meislin
(74) *Attorney, Agent, or Firm* — Duane Morris LLP; J. Rodman Steele, Jr.; Gregory M. Lefkowitz

(57) ABSTRACT

An adjustable ratchet head assembly has first and second jaw members that are connected using a pinion shaft and a cogwheel shaft. The pinion shaft has oppositely threaded end portions that engage oppositely threaded pinion shaft receiving bores in a central section of each jaw member. The cogwheel shaft has oppositely threaded end portions that engage oppositely threaded cogwheel shaft receiving bores in a proximate end of each jaw member. A pinion gear is concentric with and engages the pinion shaft. A cogwheel gear is concentric with and engages the cogwheel shaft, and is in driving engagement with the pinion gear. Driving the cogwheel gear will cause rotation of the cogwheel shaft, pinion gear and pinion shaft, and will cause the jaw members to move toward or away from each other. The ratchet head assembly is received in a cylindrical ratchet head body, which is received in a handle assembly.

17 Claims, 5 Drawing Sheets

U.S. PATENT DOCUMENTS

| | | | |
|---|---|---|---|
| D482,588 | S | 11/2003 | Lai |
| D558,009 | S | 12/2007 | Kinskey |
| 2002/0104410 | A1 | 8/2002 | Wang |
| 2003/0173882 | A1 | 9/2003 | Koons |

FOREIGN PATENT DOCUMENTS

| | | | |
|---|---|---|---|
| FR | 398433 | | 1/1909 |
| GB | 191400275 | | 7/1914 |
| WO | WO 2006/096157 | A1 | 9/2006 |
| WO | WO 2006/096482 | A1 | 9/2006 |

ADJUSTABLE RATCHET WRENCH

CROSS-REFERENCE TO RELATED APPLICATIONS

This application is a continuation-in-part of U.S. patent application Ser. No. 11/070,203, filed, Mar. 3, 2005, which is hereby incorporated herein by reference.

STATEMENT REGARDING FEDERALLY SPONSORED RESEARCH OR DEVELOPMENT

Not applicable.

REFERENCE TO A "SEQUENTIAL LISTING," A TABLE, OR A COMPUTER PROGRAM LISTING APPENDIX SUBMITTED ON A COMPACT DISC

Not applicable.

BACKGROUND OF THE INVENTION

1. Field of the Invention

The present invention relates to a tool for removing bolts and nuts, and in particular, a ratcheting tool for bolt or nut removal, which is adjustable to accommodate varying sizes of bolt heads and nuts.

2. Background of the Invention

Various tools are used for tightening or loosening bolts and nuts. Two such tools are an open-ended wrench and a closed-ended wrench. Both types of wrenches have a specific opening to accommodate corresponding size bolt heads or nuts. In order to accommodate different sizes of bolt heads or nuts, one would need different wrenches having different corresponding opening sizes.

One advancement over individual open-ended or closed-ended wrenches is an adjustable spanner or wrench having an adjustable opening to accommodate varying sizes of bolts or nuts, depending on the adjustment of the jaw opening.

An alternative design to open-ended, closed-ended and adjustable wrenches is a socket wrench, which includes a ratchet and a socket end for accepting a plurality of different size interchangeable sockets. Each socket is specifically dimensioned to accommodate a specific size bolt head or nut. An advantage of a socket wrench is its ratcheting feature which allows selective movement in either a clockwise or counterclockwise direction relative to the handle of the wrench thereby providing for what is know in the art as a "ratcheting action" to allow one to quickly loosen or tighten a bolt or nut.

A disadvantage of conventional adjustable wrenches is that they do not provide a ratcheting action. Therefore, these wrenches do not allow one to quickly and easily tighten or loosen a bolt or nut by rotating the wrench over a desired arc or degree of rotation around the bolt or nut. A disadvantage with conventional socket wrenches is that, since the sockets are not adjustable, one needs a specific socket for each different size bolt or nut one wishes to adjust. Since bolts and nuts come in variety of different sizes including both English and metric units, one needs to have numerous sockets at his or her disposal in order to accommodate these different sizes of bolts and nuts.

Accordingly, there is a need in the art for an improved tool which provides fast and easy bolt and nut removal using an adjustable tool.

BRIEF SUMMARY OF THE INVENTION

The present invention meets this need and others with a novel adjustable ratchet head assembly, and a novel ratchet wrench device.

The adjustable ratchet head assembly has first and second jaw members that are connected using a pinion shaft and a cogwheel shaft. The pinion shaft has oppositely threaded end portions that engage oppositely threaded pinion shaft receiving bores in a central section of each jaw member. The cogwheel shaft has oppositely threaded end portions that engage oppositely threaded cogwheel shaft receiving bores in a proximate end of each jaw member. The jaw members also have a distal workpiece engaging end. Rotation of the pinion shaft and cogwheel shaft will cause the jaw members to move toward or away from each other. A pinion gear is concentric with and engages the pinion shaft. A cogwheel gear is concentric with and engages the cogwheel shaft, and is in driving engagement with the pinion gear. Thus, driving the cogwheel gear will cause rotation of the cogwheel shaft, pinion gear and pinion shaft, and will cause the jaw members to move toward or away from each other.

The proximate ends of the jaw members and the cogwheel shaft are received in a diametrical jaw member/cogwheel shaft receiving slot of a cylindrical ratchet head body. The cylindrical ratchet head body also has a ratchet gear around its circumference.

A handle assembly of the invention has a ratchet head receiving structure and a pawl assembly. The cylindrical ratchet head body is received in the handle assembly ratchet head receiving structure. The pawl assembly cooperates with the ratchet gear to allow rotation of the ratchet head assembly with respect to the handle assembly in one direction and to prevent rotation of the ratchet head assembly in the other direction.

BRIEF DESCRIPTION OF THE DRAWINGS

The invention will now be described in more detail with reference to the accompanying drawing, in which.

DETAILED DESCRIPTION EXEMPLARY EMBODIMENTS OF THE INVENTION

Figure 1:
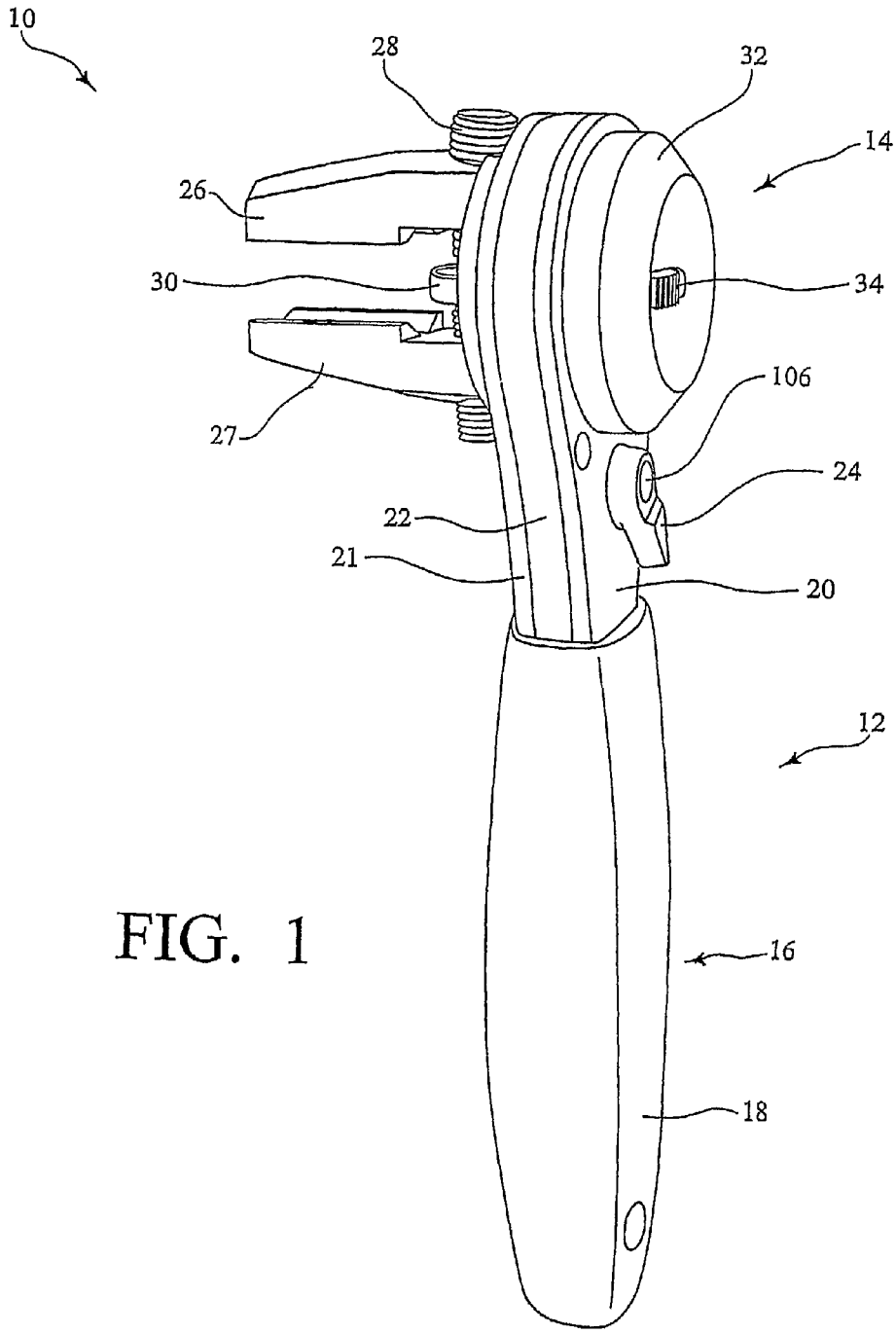
FIG. 1 is a perspective view of an exemplary adjustable ratchet wrench device according to the invention.

As shown in FIG. 1, an exemplary embodiment of an adjustable ratchet wrench device 10 according to the invention has, generally, a handle assembly 12 and an adjustable ratchet head assembly 14. Visible elements of the handle assembly 12 include a handle section 16, a hand grip member 18 covering a portion of the handle section 16, a top handle member 20, a bottom handle member 21, a spacer member 22, and a rotation direction lever 24 of a pawl assembly. Visible elements of the ratchet head assembly 14 include first and second opposing jaw members 26, 27, a pinion shaft 28, a gear shield 30, a protector cap 32, and a thumbwheel 34.

Driving, the thumbwheel 34 will move the jaw members 26, 27 toward each other or away from each other, according to the direction of rotation of the thumbwheel 34. The jaw members 26, 27 may be moved away from each other to accommodate a bolt head or nut, and then moved toward each other to engage the bolt head or nut for tightening or loosening. The handle assembly 12 holds the ratchet head assembly 14 fixed in one direction of rotation, and allows the ratchet head assembly 14 to freely rotate in the other direction of rotation, so that the handle assembly 12 can be brought back to recover the stroke without removing the jaw members 26, 27 from the bolt head or nut. The rotation direction lever 24 determines whether ratchet head assembly 14 is fixed in the clockwise or counter-clockwise direction with respect to the handle assembly 12, and allows the direction to be switched for tightening or loosening of the bolt or nut.

Figure 2:
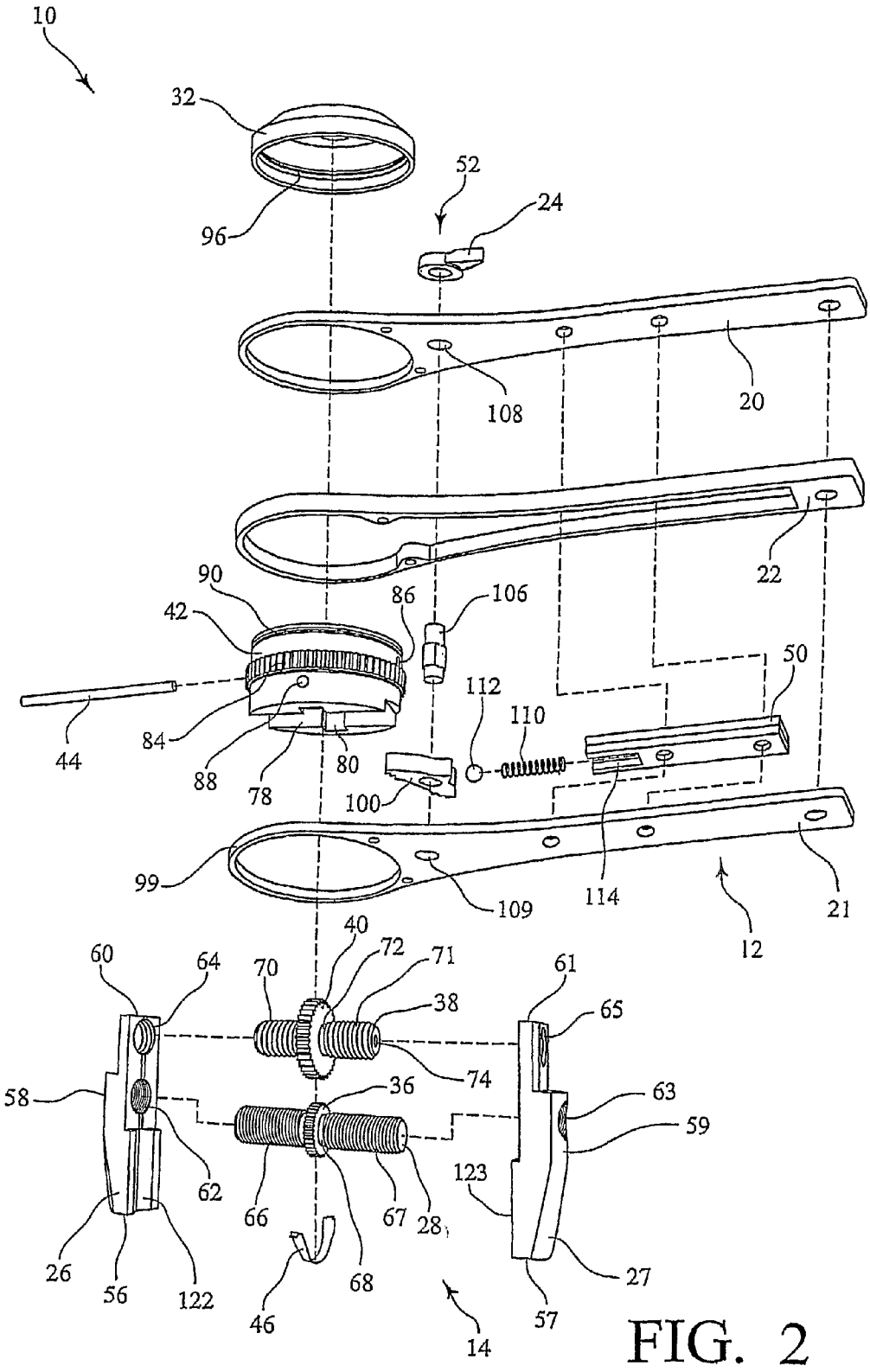
FIG. 2 is an exploded view of the primary components of the adjustable ratchet wrench device of FIG. 1.

FIG. 2 is an exploded view of the exemplary adjustable ratchet wrench device 10. The adjustable ratchet head assembly 14 has first and second opposing jaw members 26, 27, a pinion shaft 28 having a pinion gear 36, a cogwheel shaft 38 having a cogwheel gear 40, a ratchet head body 42, a rotation pin 44, a gear shield 46, and a protector cap 32. The handle assembly 12 has a top handle member 20, a bottom handle member 21, an interior handle member 50, a spacer member 22, and a pawl assembly 52.

Each of the first and second opposing jaw members 26, 27 is an elongate structure having a longitudinal axis and having a distal end 56, 57, a central section 58, 59, and a proximate end 60, 61. The distal end 56, 57 of each jaw member 26, 27 is the end that engages the bolt head, nut, or other workpiece. Each central section 58, 59 has a threaded pinion shaft receiving bore 62, 63 that is perpendicular to the longitudinal axis and extends through the member 26, 27. Each threaded pinion shaft receiving bore 62, 63 is threaded in an opposite direction from the other pinion shaft receiving bore 63, 62. Each proximate end 60, 61 has a threaded cogwheel receiving bore 64, 65 that is parallel to the pinion shaft receiving bore 62, 63 and also extends through the member 26, 27. Each threaded cogwheel receiving bore 64, 65 is also threaded in an opposite direction from the other cogwheel receiving bore 65, 64.

The pinion shaft 28 has oppositely threaded end portions 66, 67 and a central portion 68. The pinion gear 36 is concentric with and engages the central portion 68 of the pinion shaft 28 between the oppositely threaded end portions 66, 67, such that when the pinion gear 36 is driven, the pinion shaft 28 will rotate. The pinion gear 36 may be integral with the pinion shaft 28, or may be otherwise fastened, attached, affixed, joined, connected, or coupled to the pinion shaft 28. Each of the pinion shaft oppositely threaded end portions 66, 67 is received in and threadedly engaged with a respective jaw member threaded pinion shaft receiving bore 62, 63, such that rotation of the pinion shaft 28 in the pinion shaft receiving bores 62, 63 will cause the jaw members 26, 27 to move toward or away from each other.

The cogwheel shaft 38 also has oppositely threaded end portions 70, 71 and a central portion 72. The cogwheel gear 40 is concentric with and engages the central portion 72 of the cogwheel shaft 38 between the oppositely threaded end portions 70, 71, such that when the cogwheel gear 40 is driven, the cogwheel shaft 38 will rotate. The cogwheel gear 40 may be integral with the cogwheel shaft 38, or may be otherwise fastened, attached, affixed, joined, connected, or coupled to the cogwheel shaft 28. Additionally, the cogwheel shaft 38 has a rotation pin receiving bore 74 through a longitudinal axis of the cogwheel shaft 38. Each of the cogwheel shaft oppositely threaded end portions 70, 71 is received in and threadedly engaged with a respective jaw member cogwheel shaft receiving bore 64, 65, such that rotation of the cogwheel shaft 38 in the cogwheel shaft receiving bores 64, 65 will cause the jaw members 26, 27 to move toward or away from each other. The cogwheel shaft 38 and pinion shaft 28 have a parallel configuration and are perpendicular to the longitudinal axes of the first and second opposing jaw members 26, 27.

The pinion shaft receiving bores 62, 63, cogwheel shaft receiving bores 64, 65, pinion shaft 28, pinion gear 36, cogwheel shaft 38 and cogwheel gear 40 are located and scaled such that the cogwheel gear 40 engages the pinion gear 36. The cogwheel gear 40 is also referred to as a "thumbwheel 34" because in use, it is driven by a user's thumb to open and close the jaw members 26, 27. When the user drives the cogwheel gear/thumbwheel 40 (34), the parallel pinion shaft 28 and cogwheel shaft 38 rotate and the jaw members 26, 27 ride on the pinion shaft 28 and cogwheel shaft 38 toward or away from each other. Advantageously, the parallel pinion shaft 28 and cogwheel shaft 38 arrangement provides smooth, stable, even and easy adjustment of the jaw members 26, 27, and adds clamping force to counter the rotational moments created when the distal, workpiece engaging ends 56, 57 of the jaws 26, 27 are tightened around a bolt head, nut, or other workpiece. The gears and threads are also selected to maintain the jaw members 26, 27 in a proportional relationship. In the exemplary embodiment, the cogwheel gear 40 and threaded end portions 70, 71 of the cogwheel shaft 38 have a ratio with the pinion gear 36 and threaded end portions 66, 67 of the pinion shaft 28 such that one revolution of the cogwheel gear 40 will advance the pinion gear 36 two revolutions.

As shown in FIG. 3*a*, FIG. 3*b*, FIG. 3*c*, and FIG. 4, the ratchet head body 42 has a generally cylindrical body 76, a diametrical jaw member/cogwheel shaft receiving slot 78 for receiving the proximate ends 60, 61 of the jaw members 26, 27 and the cogwheel shaft 38, a diametrical cogwheel gear receiving slot 80 for receiving the cogwheel gear 40, a rotation pin 44 (shown in FIG. 2 and in broken line representation in FIG. 4), and a ratchet gear 84. The cogwheel gear receiving slot 80 is transverse to the jaw member/cogwheel shaft receiving slot 78. The ratchet head body 42 is positioned around the proximate ends 60, 61 of the jaw members 26, 27, the cogwheel shaft 38, and the cogwheel gear 40 such that the proximate ends 60, 61 of the jaw members 26, 27 and the cogwheel shaft 38 are received in the jaw member/cogwheel shaft receiving slot 78, and such that the cogwheel gear 40 is received in the cogwheel gear receiving slot 80. A portion of the cogwheel gear 40 protrudes from the ratchet head body 42 to act as a thumbwheel 34.

Figure 4:
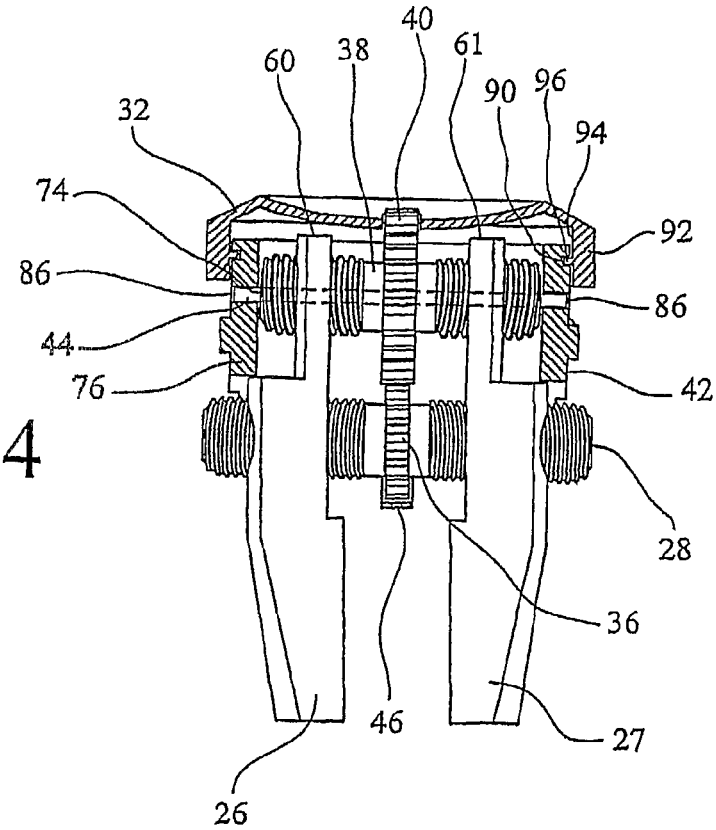
FIG. 4 is a partial sectional view of an exemplary ratchet head assembly according to an aspect of the invention (for clarity of understanding, selected elements are shown in section while other elements are shown in plan)

Shown in FIG. 2 and FIG. 4, the ratchet head body 42 also has a diametrical rotation pin receiving bore 86 aligned with the jaw member/cogwheel shaft receiving slot 78 and with the cogwheel shaft rotation pin receiving bore 74. The rotation pin 44 extends through the ratchet head body rotation pin receiving bore 86 and the cogwheel shaft rotation pin receiving bore 74 to rotatably couple the cogwheel shaft 38 to the ratchet head body 42.

Shown in FIG. 2 through FIG. 4, the ratchet gear 84 engages the circumference of the ratchet head body 42, such that jamming of the ratchet gear 84 will prevent rotation of the ratchet head body 42. The ratchet gear 84 may be integral with the ratchet head body 42, or may be otherwise fastened, attached, affixed, joined, connected, or coupled to the ratchet head body 42.

Additionally, the ratchet head body 42 has a diametrical gear shield receiving bore 88 aligned with the cogwheel gear receiving slot 80 along a lower portion of the ratchet head body 42, and a protector cap lip receiving groove 90 positioned around a top portion of the ratchet head body 42.

The gear shield member 46 is received in the openings of the ratchet head body gear shield receiving bore 88 on the inside of the cogwheel receiving slot 80. The gear shield member 46 covers and protects the cogs or teeth of the pinion gear 36 from damage from the workpiece or other objects that may pass between the jaw members 26, 27. In the exemplary embodiment, the gear shield member 46 has a one-piece construction and follows the curvature of the pinion gear 36. The gear shield member 46 is resilient, which allows it to be flexed such that its ends can be inserted into the openings of the ratchet head body shield receiving bore 88 on the inside of the cogwheel receiving slot 80.

Similarly, best shown in FIG. 4, the protector cap 32 protects the top portion of the ratchet head body 42 and the cogwheel gear 40. The protector cap 32 is sized to fit over the top portion of the ratchet head body 42, and has a concave upper wall. The protector cap 32 protects the cogwheel gear 40, provides comfort for the user's thumb, and provides an aesthetic benefit (i.e. makes it "meaner looking") to the ratchet wrench device 10. The protector cap 32 has a cylindrical side wall 92 having an inner surface 94. A lip 96 extends from the inner surface 94, and cooperates with the protector cap lip receiving groove 90 positioned around the top portion of the ratchet head body 42 to hold the protector cap 32 to the ratchet head body 42.

Returning now to FIG. 2, the top handle member 20 and bottom handle member 21 have aligned ring portions 98, 99 in spaced relation forming a ratchet head receiving structure. The interior handle member 50 and the spacer member 22 hold the top handle member 20 and bottom handle member 21 in such spaced relation. The ratchet head body 42 is received within the ratchet head receiving structure with the ratchet gear 84 positioned in the space between the top handle member ring portion 98 and bottom handle member ring portion 99 such that the ratchet head assembly 14 is rotatably coupled to the handle assembly 12. The spacer member 22 has a height greater than the width of the ratchet gear 84 to facilitate rotation of the ratchet head assembly 14 in the ratchet head receiving structure of the handle assembly 12.

Figure 3A:
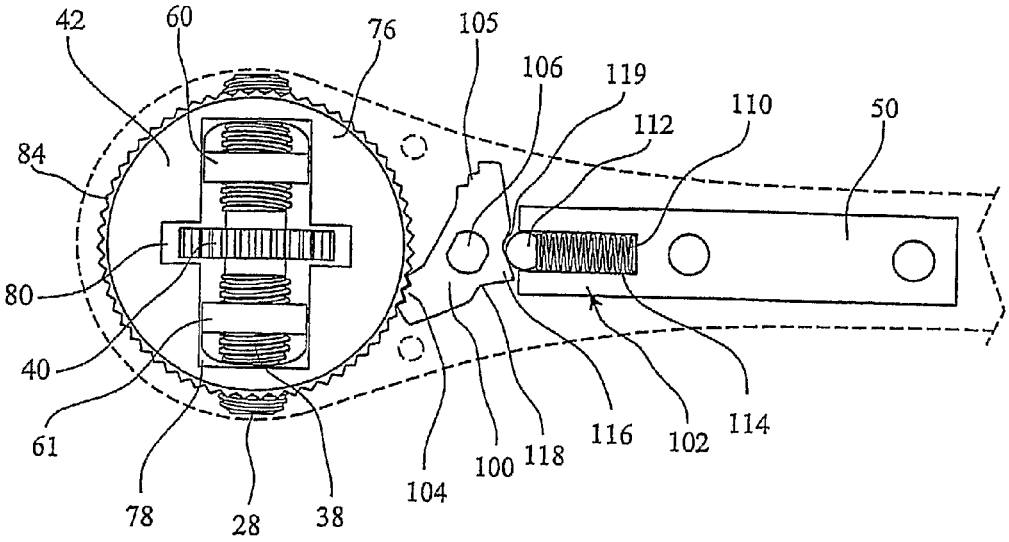
FIG. 3*a* is a top view of selected parts of an exemplary ratchet head assembly, pawl assembly, and interior handle member according to various aspects of the invention (an exemplary bottom handle member is partially show in broken line representation)
Figure 3B:
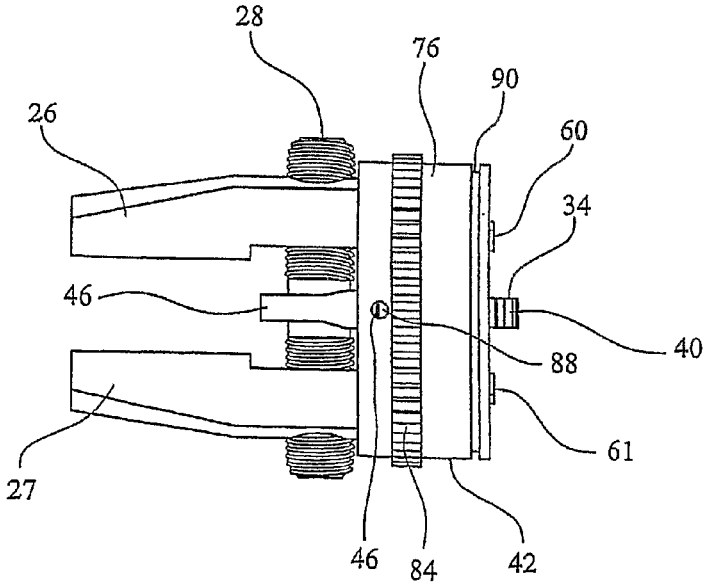
FIG. 3*b* is a side view of the exemplary ratchet head assembly of FIG. 3*a;*
Figure 3C:
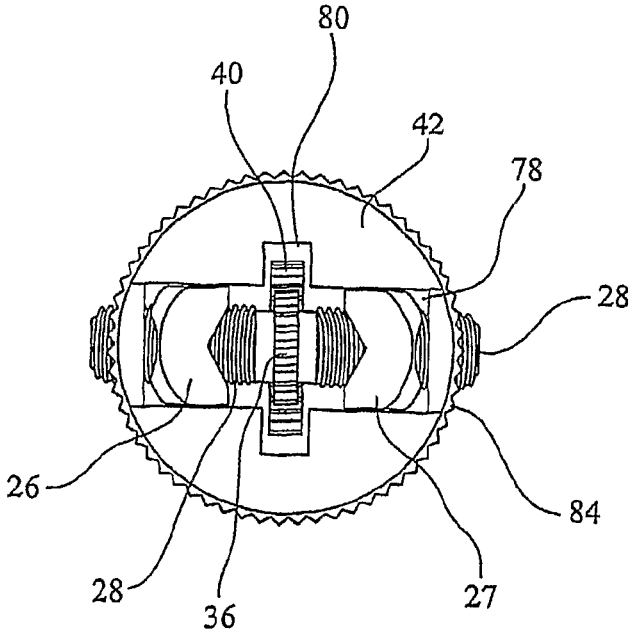
FIG. 3*c* is a bottom view of the exemplary ratchet head assembly of FIG. 3*a;*

Shown in FIG. 2 and FIG. 3*a*, the pawl assembly 52 cooperates with the ratchet gear 84 to allow rotation of the ratchet head assembly 14 with respect to the handle assembly 12 and to prevent rotation of the ratchet head assembly 14 in the other direction. The pawl assembly 52 has a double pawl member 100, a rotation direction lever 24, and a biasing member 102. The double pawl member 100 has opposed pawls 104, 105 and a pivot pin 106 extending through or from top and bottom surfaces of the double pawl member 100. The pivot pin 106 extends through aligned holes 108, 109 in the top handle member 20 and bottom handle member 21, respectively, to engage the double pawl member 100 and to pivot one of the pawls 104, 105 against the ratchet gear 84. The pivot pin 106 may engage the double pawl member 100 through a flat spot or other irregular shape in the pin 106 which acts on a mating opening in the double pawl member 100. Alternatively, the pivot pin 106 may be integral with the double pawl member 100. The rotation direction lever 24 is attached to the portion of the pivot pin 106 extending through the hole 108 in the top handle member 20. The biasing member 102 applies a biasing force to the double pawl member 100 to bias one of the opposed pawls 104, 105 against the ratchet gear 84, which jams the ratchet gear 84 in one direction of rotation, and allows movement in the other direction of rotation. Thus, the biasing member 102 holds the double pawl member 100 in the selected orientation until a changing force is applied to the rotation direction lever 24 to overcome the biasing force and change the direction of allowable rotation of the ratchet head assembly 14.

In the exemplary embodiment, the biasing member is a spring 110 and ball bearing 112 assembly. The spring 110 and ball bearing 112 assembly is positioned in a cavity 114 in the interior handle member 50 adjacent the double pawl member 100. The double pawl member 100 has a head 116 and bearing notches 118, 119 on either side of the head 116. The head 116 is opposed to the opposed pawls 104, 105, in a substantially triangular arrangement. The spring 110 and ball bearing 112 assembly cooperates with the head 116 and bearing notches 118, 119 such that the ball bearing 112 is biased against the double pawl member 100 in one of the bearing notches 118, 119 to provide the biasing force.

The top handle member 20, bottom handle member 21, and interior handle member 50 are held together by fasteners, such as rivets, as needed.

Figure 5:
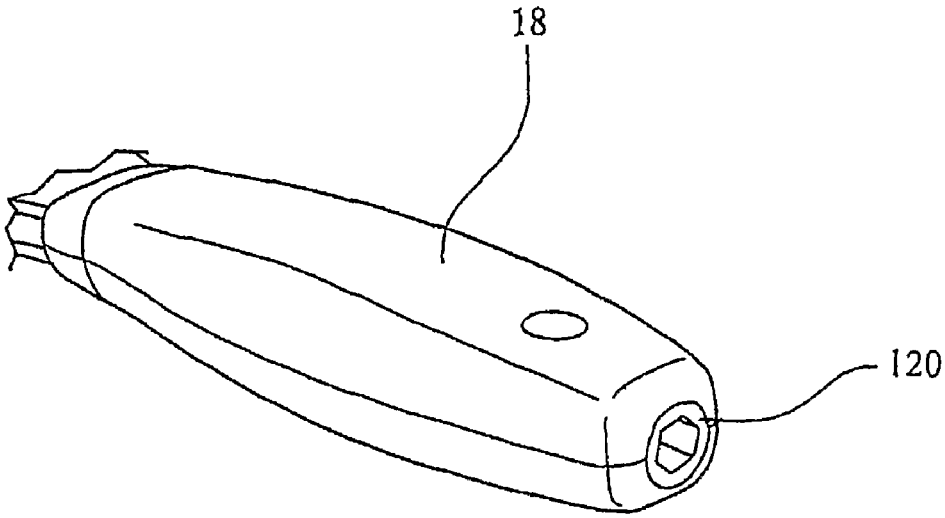
FIG. 5 is a perspective view of an exemplary hand grip member according to an aspect of the invention.

As shown in FIG. 1 and FIG. 5, the hand grip member 18 of the exemplary embodiment is a boot that slides over a portion of the handle section 16 of the handle assembly 12, to provide ergonomic adaptation of the ratchet wrench device 10 to a human hand. Advantageously, the end of the hand grip member 18 may contain a socket 120 for holding a tool bit.

Additionally, the words "right" and "left" may be added to the top handle member 20 adjacent the rotation direction lever 24 to provide a visual indication with the lever 24 pointing to the direction of fixed rotation of the ratchet wrench device 10. Likewise, the words "open" and "close" may be added to the protector cap 32 to provide a visual indication of the rotation direction of the thumbwheel 34 to open and close the jaw members 26, 27.

Referring now to FIG. 2, the inner surfaces 122, 123 of the jaw members 26, 27 can be magnetized to allow for positioning of a screw-driver bit for use of the device as a standard screw driver.

Although the invention has been described in considerable detail with respect to exemplary embodiments, it will be apparent to those skilled in the art that the invention is capable of numerous modifications and variations without departing from the spirit and scope of the claimed invention.

I claim:

1. An adjustable ratchet head assembly comprising:

first and second opposing elongate jaw members, each jaw member having:

a working engaging distal end;

a central section;

a proximate end;

a threaded pinion shaft receiving bore through said central section; and a threaded cogwheel shaft receiving bore through said proximate end;

a pinion shaft having oppositely threaded end portions in threaded engagement with a respective jaw member threaded pinion shaft receiving bore;

a pinion gear concentric with said pinion shaft;

a cogwheel shaft having oppositely threaded end portions in threaded engagement with a respective cogwheel shaft receiving bore;

a cogwheel gear concentric with said cogwheel shaft, said cogwheel gear in driving engagement with said pinion gear, such that driving of the cogwheel gear will cause rotation of the cogwheel shaft, pinion gear and pinion shaft, and will cause the jaw members to move toward or away from each other;

a generally cylindrical ratchet head body having a diametrical jaw member/cogwheel shaft receiving slot, said cylindrical body positioned around said jaw member proximate ends, said cogwheel shaft, and said cogwheel such that said jaw member proximate ends and said cogwheel shaft are received in said jaw member/cogwheel shaft receiving slot, and such that a portion of said cogwheel gear protrudes from said ratchet head body to act as a thumbwheel; and a gear shield member for covering and protecting said pinion gear, wherein said ratchet head body further has a cogwheel gear receiving slot and a diametrical gear shield receiving bore, said cogwheel gear receiving slot positioned transverse to said diametrical jaw member/cogwheel shaft receiving slot for receiving said cogwheel gear, said gear shield receiving bore aligned with said cogwheel gear receiving slot along a lower portion of said ratchet head body, said gear shield received in openings of said ratchet head body gear shield receiving bore on the inside of said cogwheel gear receiving slot.

2. The adjustable ratchet head assembly of claim 1, wherein each of said first and second opposing elongate jaw members has a longitudinal axis, wherein each said threaded pinion shaft receiving bore is perpendicular to the respective jaw member longitudinal axis, and wherein each said cogwheel shaft receiving bore is parallel to the respective pinion shaft receiving bore, such that said pinion shaft and said cogwheel shaft have a parallel configuration and are perpendicular to said jaw member longitudinal axes.

3. The adjustable ratchet head assembly of claim 2, wherein said pinion shaft further has a central portion, wherein said pinion gear engages said pinion shaft central portion, wherein said cogwheel shaft further has a central portion, and wherein said cogwheel gear engages said cogwheel shaft central portion.

4. The adjustable ratchet head assembly of claim 1, further comprising a rotation pin, wherein said cogwheel shaft further has a longitudinal axis and rotation pin receiving bore through said longitudinal axis of said cogwheel shaft, and wherein said ratchet head body further has a diametrical rotation pin receiving bore aligned with said jaw member/cogwheel shaft receiving slot and with said cogwheel shaft rotation pin receiving bore, said rotation pin extending through said ratchet head body rotation pin receiving bore and said cogwheel shaft rotation pin receiving bore to rotatably couple said cogwheel shaft to said ratchet head body.

5. The adjustable ratchet head assembly of claim 1, further having a protector cap for protecting said cogwheel, said protector cap sized to fit over the top portion of the ratchet head body, having a concave upper wall and a cylindrical side wall having an inner surface, said side wall inner surface having a lip extending therefrom, wherein said ratchet head body further has a protector cap lip receiving groove positioned around a top portion of the ratchet head body, said protector cap lip cooperating with said protector cap lip receiving groove to hold said protector cap to said ratchet head body.

6. A ratchet wrench device comprising:

an adjustable ratchet head assembly having:

first and second opposing elongate jaw members, each jaw member having:

a central section;

a proximate end;

a threaded pinion shaft receiving bore through said central section; and a threaded cogwheel shaft receiving bore through said proximate end;

a pinion shaft having oppositely threaded end portions in threaded engagement with a respective jaw member threaded pinion shaft receiving bore;

a pinion gear concentric with said pinion shaft;

a cogwheel shaft having oppositely threaded end portions in threaded engagement with a respective cogwheel shaft receiving bore;

a cogwheel gear concentric with said cogwheel shaft, said cogwheel gear in driving engagement with said pinion gear, such that driving of the cogwheel gear will cause rotation of the cogwheel shaft, pinion gear and pinion shaft, and will cause the jaw members to move toward or away from each other;

a cylindrical ratchet head body having:

a diametrical jaw member/cogwheel shaft receiving slot, said jaw member proximate ends and said cogwheel shaft received in said jaw member/cogwheel shaft receiving slot such that a portion of said cogwheel gear protrudes from said ratchet head body to act as a thumbwheel; and a ratchet gear around the circumference of said ratchet head body;

a handle assembly having a ratchet head receiving structure and a pawl assembly, said cylindrical ratchet head body received in said handle assembly ratchet head receiving structure, said pawl assembly cooperating with said ratchet gear to allow rotation of said ratchet head assembly with respect to said handle assembly in one direction and to prevent rotation of said ratchet head assembly in the other direction; and a gear shield member for covering and protection said pinion gear, wherein said ratchet head body further has a cogwheel gear receiving slot and a diametrical gear shield receiving bore, said cogwheel gear receiving slot positioned transverse to said jaw member/cowheel shaft receiving slot for receiving said cogwheel gear, said gear shield receiving bore aligned with said cogwheel gear receiving slot along a lower portion of said ratchet head body, said gear shield received in openings of said ratchet head body gear shield receiving bore on the inside of said cogwheel gear receiving slot.

7. The ratchet wrench device of claim 6, said handle assembly comprising a top handle member having a ring portion and a bottom handle member having a ring portion, said top handle member ring portion and said bottom handle member ring portion in aligned and spaced relation forming said ratchet head receiving structure, said ratchet gear positioned in the space between said top handle member ring portion and said bottom handle member ring portion such that the ratchet head assembly is rotatably coupled to the handle assembly.

8. The ratchet wrench device of claim 7, said handle assembly further comprising a spacer member for holding said top handle member ring portion and said bottom handle member ring portion in said spaced relation.

9. The ratchet wrench device of claim 8, said top handle member and said bottom handle member having aligned pivot pin receiving holes, said pawl assembly comprising:

a pivot pin positioned in said pivot pin receiving holes, said pivot pin having a top portion extending beyond an outer surface of a respective one of said exterior handle members;

a double pawl member having opposed pawls, said double pawl member attached to said pivot pin and positioned between said top handle member and said bottom handle member;

a rotation direction lever affixed to said top portion of said pivot pin, for pivoting one of said opposed pawls against said ratchet gear for controlling the direction of allowable rotation of said ratchet head assembly; and a biasing member for applying a biasing force to said double pawl member to bias said one of said opposed pawls against said ratchet gear.

10. The ratchet wrench device of claim 9, said handle assembly further comprising an interior handle member having a cavity adjacent said double pawl member, said double pawl member further having a head opposed to said opposed pawls and bearing notches on either side of said head, said biasing member comprising a spring and ball bearing assembly positioned in said cavity such that said ball bearing is biased against said double pawl member in one of said bearing notches.

11. The adjustable ratchet head assembly of claim 6, further comprising a rotation pin, wherein said cogwheel shaft further has a longitudinal axis and rotation pin receiving bore through said longitudinal axis of said cogwheel shaft, and wherein said ratchet head body further has a diametrical rotation pin receiving bore aligned with said jaw member/cogwheel shaft receiving slot and with said cogwheel shaft rotation pin receiving bore, said rotation pin extending through said ratchet head body rotation pin receiving bore and said cogwheel shaft rotation pin receiving bore to rotatably couple said cogwheel shaft to said ratchet head body.

12. The adjustable ratchet head assembly of claim 6, further having a protector cap for protecting said cogwheel, said protector cap sized to fit over the top portion of the ratchet head body, said protector cap having a concave upper wall and a cylindrical side wall having an inner surface, said side wall inner surface having a lip extending therefrom, wherein said ratchet head body further has a protector cap lip receiving groove positioned around a top portion of the ratchet head body, said protector cap lip cooperating with said protector cap lip receiving groove to hold said protector cap to said ratchet head body.

13. A ratchet wrench device comprising:

an adjustable ratchet head assembly having:

first and second opposing elongate jaw members, each jaw member having:

a central section;

a proximate end;

a threaded pinion shaft receiving bore through said central section; and a threaded cogwheel shaft receiving bore through said proximate end;

a pinion shaft having oppositely threaded end portions in threaded engagement with a respective jaw member threaded pinion shaft receiving bore;

a pinion gear concentric with said pinion shaft;

a cogwheel shaft having oppositely threaded end portions in threaded engagement with a respective cogwheel shaft receiving bore;

a cogwheel gear concentric with said cogwheel shaft, said cogwheel gear in driving engagement with said pinion gear, such that driving of the cogwheel gear will cause rotation of the cogwheel shaft, pinion gear and pinion shaft, and will cause the jaw members to move toward or away from each other;

a cylindrical ratchet head body having:

a diametrical jaw member/cogwheel shaft receiving slot, said jaw member proximate ends and said cogwheel shaft received in said jaw member/cogwheel shaft receiving slot such that a portion of said cogwheel gear protrudes from said ratchet head body to act as a thumbwheel; and a ratchet gear around the circumference of said ratchet head body;

a handle assembly having a ratchet head receiving structure and a pawl assembly, said cylindrical ratchet head body received in said handle assembly ratchet head receiving structure, said pawl assembly cooperating with said ratchet gear to allow rotation of said ratchet head assembly with respect to said handle assembly in one direction and to prevent rotation of said ratchet head assembly in the other direction; and a protector cap for protecting said cogwheel, said protector cap sized to fit over the top portion of the ratchet head body, said protector cap having a concave upper wall and a cylindrical side wall having an inner surface, said side wall inner surface having a lip extending therefrom, wherein said ratchet head body further has a protector cap lip receiving groove positioned around a top portion of the ratchet head body, said protector cap lip cooperating with said protector cap lip receiving groove to hold said protector cap to said ratchet head body.

14. The ratchet wrench device of claim 13, said handle assembly comprising a top handle member having a ring portion and a bottom handle member having a ring portion, said top handle member ring portion and said bottom handle member ring portion in aligned and spaced relation forming said ratchet head receiving structure, said ratchet gear positioned in the space between said top handle member ring portion and said bottom handle member ring portion such that the ratchet head assembly is rotatably coupled to the handle assembly.

15. The ratchet wrench device of claim 14, said handle assembly further comprising a spacer member for holding said top handle member ring portion and said bottom handle member ring, portion in said spaced relation.

16. The ratchet wrench device of claim 15, said top handle member and said bottom handle member having aligned pivot pin receiving holes, said pawl assembly comprising:

a pivot pin positioned in said pivot pin receiving holes, said pivot pin having a top portion extending beyond an outer surface of a respective one of said exterior handle members;

a double pawl member having opposed pawls, said double pawl member attached to said pivot pin and positioned between said top handle member and said bottom handle member;

a rotation direction lever affixed to said top portion of said pivot pin, for pivoting one of said opposed pawls against said ratchet gear for controlling the direction of allowable rotation of said ratchet head assembly; and a biasing member for applying a biasing force to said double pawl member to bias said one of said opposed pawls against said ratchet gear.

17. The ratchet wrench device of claim 16, said handle assembly further comprising an interior handle member having a cavity adjacent said double pawl member, said double pawl member further having a head opposed to said opposed pawls and bearing notches on either side of said head, said biasing member comprising a spring and ball bearing assembly positioned in said cavity such that said ball bearing is biased against said double pawl member in one of said bearing notches.

* * * * *